US005787913A

United States Patent [19]

Li

[11] Patent Number: 5,787,913

[45] Date of Patent: Aug. 4, 1998

[54] STAIRS CLIMBING WALKER

[76] Inventor: Tianfu Li, 27165 Colleen Ct., Dearborn Hts., Mich. 48127

[21] Appl. No.: 859,857

[22] Filed: May 21, 1997

[51] Int. Cl.[6] ..... A61H 3/00

[52] U.S. Cl. ..... 135/67; 135/78; 135/76; 280/87.021

[58] Field of Search ..... 135/65, 67, 66, 135/69, 77, 78, 79, 80; 297/5–7; 482/66, 68; 280/87.021, 87.041, 87.051

[56] References Cited

U.S. PATENT DOCUMENTS

| | | | |
|---|---|---|---|
| 2,708,473 | 5/1955 | Gable et al. | 135/67 |
| 3,167,700 | 1/1965 | Drury, Jr. | 135/67 |
| 3,421,529 | 1/1969 | Vestal | 135/67 |
| 3,455,313 | 7/1969 | King | 135/67 |
| 3,688,789 | 9/1972 | Bunch | 135/67 |
| 4,094,331 | 6/1978 | Rozsa | 135/67 |
| 4,411,283 | 10/1983 | Lucarelli | 297/5 X |
| 5,349,977 | 9/1994 | Wood | 135/69 X |
| 5,603,517 | 2/1997 | Lorman | 280/87.021 X |
| 5,649,558 | 7/1997 | Richard | 135/69 X |
| 5,702,326 | 12/1997 | Renteria | 135/67 X |

*Primary Examiner*—Lanna Mai

[57] ABSTRACT

A walker to assist physically impaired persons in ascending and descending stairs, has two rear legs pivotally attached to two front legs. When the walker is in use, the rear legs are locked against any pivotal movement; when stairs are to be negotiated, a locking member is released to permit relative pivotal movement of the rear legs in respect to the front legs. Thus, the front and rear legs can be placed on the staircase. After this has been done, the legs again are locked into position. The walker maintains this relative position so that the person using it may negotiate the stairs. The locking member is in the form of a toothed substantially circular gear and spring biased bolt.

4 Claims, 2 Drawing Sheets

STAIRS CLIMBING WALKER

BACKGROUND

This invention relates to an assisting device to assist physically impaired person in walking from place to place, and more particularly to assist physically impaired person ascending. descending the stairs and stand up from sitting position.

U.S. Pat. No. 5,499,645 disclosed stair step walker can be placed on one stair and has assist bar on each side to support user ascending and descending the Stairs. This walker is too easy to be-tilt because the support base is too small, it is not safe.

U.S. Pat. No. 5,263,506 disclosed stair walker has legs pivotally attached to support arms can negotiate with different high of the stairs. This walker is not safe to use because the support arms can. not maintain level during ascending and descending the stairs. And is complex and expensive to manufacture.

It is desirable. to provide a walker which is readily adjustable to fit the purpose of assisting in ascending or descending stairs, also assist user stand up from sitting in chair or bed, and which provides greater safety in use and easier to manufacture than prior art.

SUMMARY OF THE INVENTION

It is an object of this invention to provide an improved walker for assisting physically impaired person in ascending and descending stairs.

It is another object of this invention to provide a readily adjustable, safe in use, in assisting in ascend-descend the stairs It is further objective of this invention to provide a walker can assist users in standing up from sitting position, which employs rear legs pivot attach to the front legs may be firmly locked in place once the relative position of front and rear legs have been adjusted by pivot rear legs to a desired position.

BRIEF DESCRIPTION OF TIE DRAWING

FIG. 1 perspective view of a preferred embodiment of invention;

Figure 1:
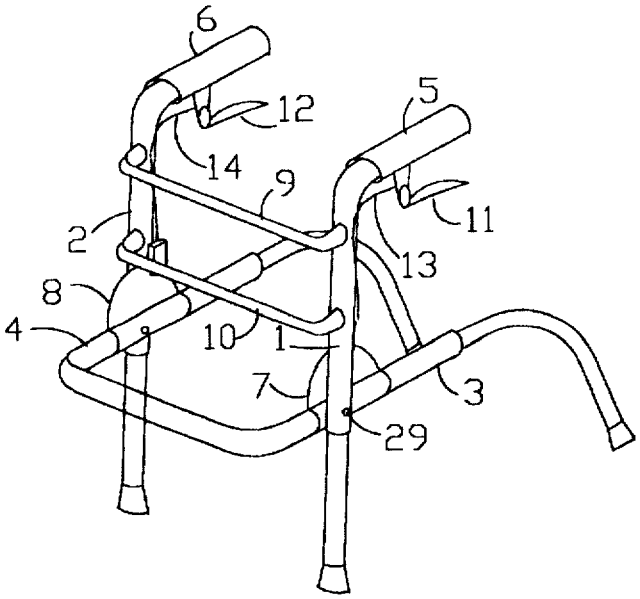
Figure 5:
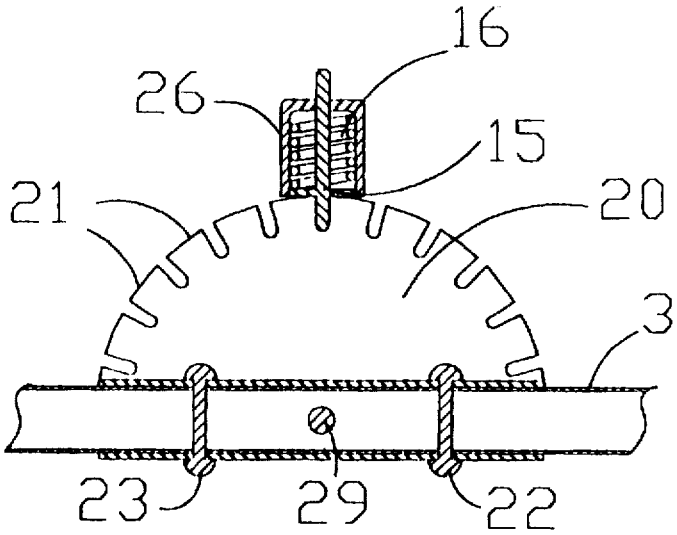
Figure 6:
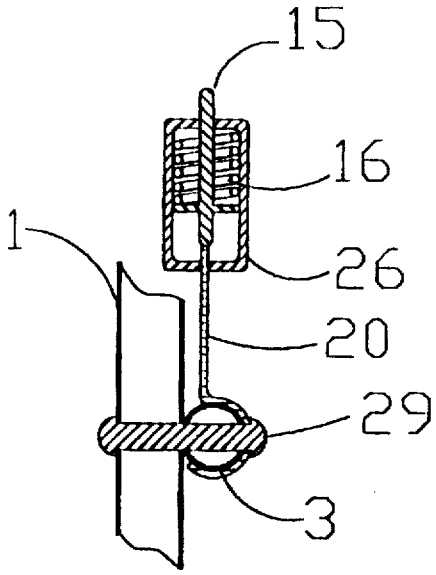
Figure 7:
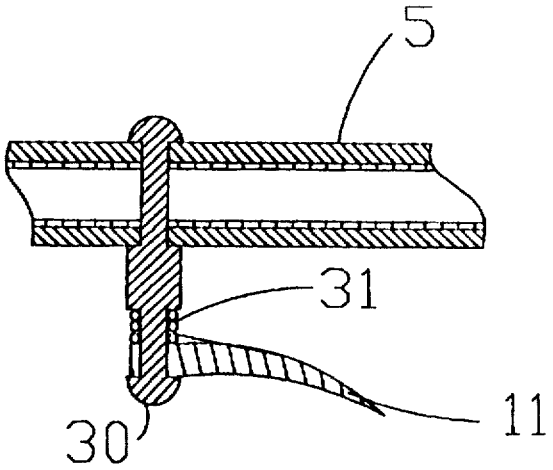

FIG. 5 detailed partially cut-away side view of a portion of locking device shown in FIG. 1;

FIG. 6 detailed partially cut-away front view of a portion of locking device shown in FIG. 1;

FIG. 7 is a detailed partially cut-away side view of the brake handle.

DETAILED DESCRIPTION

Please refer to FIG. 1. The general configuration of the walker include four legs 1, 2, 3, and 4. The two front legs 1 and 2 extending downward, two rear legs 3. 4. pivotally attach to two front legs on left and right side extending backward first and downward second. The up end of two front legs bend horizontally backward form left and right arms S and 6. Two front braces 9 and 10 connect two front legs 1 and 2 together. one brace 9 put at top of the front legs and other brace put approximately at medial of the length of the front legs. Two bike brake handle 11 and 12 attach to the arms on each side and connect to the locking device 7 and 8 oil left and right side through cable 13 and 14. The brake handle can swing away toward front.

Figure 2:
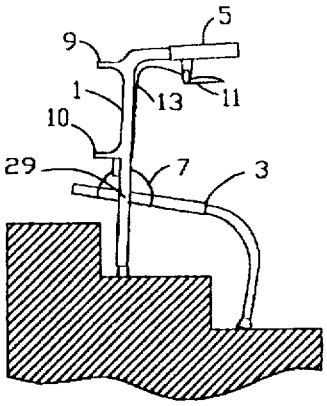
FIG. 2 and 3 are side diagrammatic view of embodiment of FIG. 1, show it used to ascend and: descend stairs respectively.
Figure 3:
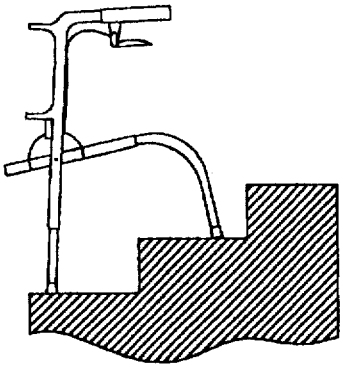
Figure 4:
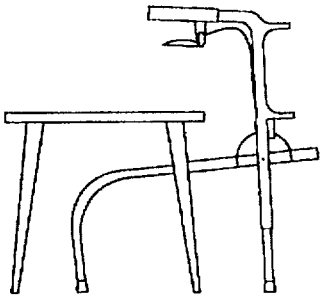
FIG. 4 is side diagrammatic view of embodiment of FIG. 1, show it used to assist user standing up from sitting.

Refer to FIGS. 2, 3 and 4. Show the walker is capable of different relative orientations of the parts to permit the walker to be used to support the user in ascend-descend stairs and purport user stand up from sitting.

The manner in which this is accomplished is best understood from an examination of the walker of FIG. 1 taken in conjugations with cross-sectional detailed illustrations of FIG. 5 and 6. These figures show detail of the locking device 7. It is understood that the mechanisms, which is illustrated in FIGS. 5 and 6 also present on right side of the walker, show such deal on each side would be redundant and unnecessary.

The locking device 7 has the semi circular gear 20 attach to rear leg 3 through screw 22 and 23, the pivot axis of the rear leg through: the center of the circle of the gear. The locking bolt 15 and helical spring 16 hold by house 26 which located at the left end of the medial brace 10. The house 26 has a longitude open gap 27 which contain up portion of the semi circular gear 20 and its teeth 2, along the semi circular gear sliding in the housing on longitude direction. The locking bolt 15 push downward by a helical spring 16 fit into gear wheel teeth 21 said lock the rear leg 3 from pivot on front leg 1 and can be release out of the teeth 21 by pulling cable 13 to along rear leg 3 to pivot.

Refer to FIG. 7. Show the brake handle has axle 30 and spring 31 to along the handle 11 to swing away. It will be same suture for handle 12.

When the user ambulate on the level surface, the rear leg 3 is locked by the bolt 15. When the user approach to the stairs, the user can squeeze the bike handle 11, the cable 13 will pull the bolt 15 out of the gap in between the teeth 21 of the semi gear, the rear leg 3 can freely pivot on the axis 29 and tilt up or drop down to fit the different height of the stairs. Then the user can release the bike brake handle, the helical spring 16 push the bolt 15 downward into the gap between the teeth 21 of the semi gear 20 to lock the rear leg 3 from pivot movement, the walker will stablely place on the stairs to support the user.

What is claimed is:

1. A walker for assisting a physically impaired person in ascending and descending a flight of stair comprising:

a left and a right front leg, said front legs being connected by at least one cross brace defining a main frame;

a support handle being formed on the upper end of each front leg;

a left and a right rear leg; each rear leg having a lower end and being pivotally attached to each respective front leg at a pivot connection located on each front leg; each rear leg extending rearwardly and downwardly away from the respective front leg so that the lower end contacts the ground;

a releasable locking means mounted on each rear leg adjacent said pivot connection; said locking means includes a semi-circular gear and a pin means, said pin means releasably engages said gear to lock said rear leg in different angular positions with the respective front leg a pivotable brake handle being mounted on each front leg adjacent said support handle; a cable connecting each brake handle to the respective pin means;

whereby said brake handles are squeezed to release said pin means from said lock means and said rear legs are pivoted to a selected angular position with respect to said front legs; upon release of the brake handles, said pin means engages said gear to set said locking means into a locking position to lock said rear legs in the selected angular position.

2. A walker as recited in claim 1, wherein said gear comprising teeth protrude upwardly to releasably engages said pin means.

3. A walker as recited in claim 2, wherein said pin means comprising a bolt being spring biased into engagement with teeth on said gear.

4. A walker as recited in claim 1, wherein said rear legs are connected by a cross brace.

* * * * *